US009501004B2

(12) United States Patent
Kikuchi

(10) Patent No.: US 9,501,004 B2
(45) Date of Patent: Nov. 22, 2016

(54) FIXING APPARATUS THAT CONTROLS POWER-ON AND POWER-OFF OF AN INDUCTION CURRENT GENERATOR AND IMAGE FORMING APPARATUS HAVING THE SAME

(71) Applicants: KABUSHIKI KAISHA TOSHIBA, Tokyo (JP); TOSHIBA TEC KABUSHIKI KAISHA, Tokyo (JP)

(72) Inventor: Kazuhiko Kikuchi, Yokohama Kanagawa (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/559,772

(22) Filed: Dec. 3, 2014

(65) Prior Publication Data

US 2015/0168888 A1 Jun. 18, 2015

(30) Foreign Application Priority Data

Dec. 13, 2013 (JP) ..... 2013-257992

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
CPC ..... G03G 15/2039
See application file for complete search history.

(56) References Cited

U.S. PATENT DOCUMENTS

| | | | | |
|---|---|---|---|---|
| 5,552,582 | A * | 9/1996 | Abe et al. | 219/619 |
| 5,950,060 | A * | 9/1999 | Isogai | 399/324 |
| 2004/0141038 | A1* | 7/2004 | Takagi et al. | 347/102 |
| 2005/0169657 | A1* | 8/2005 | Hanamoto et al. | 399/88 |
| 2005/0169658 | A1* | 8/2005 | Hanamoto et al. | 399/88 |
| 2010/0054786 | A1* | 3/2010 | Hara | 399/69 |
| 2014/0314456 | A1* | 10/2014 | Kikuchi | 399/329 |
| 2014/0314457 | A1 | 10/2014 | Kikuchi | |

FOREIGN PATENT DOCUMENTS

JP 2003007438 A 1/2003

* cited by examiner

*Primary Examiner* — G. M. Hyder
(74) *Attorney, Agent, or Firm* — Patterson & Sheridan, LLP

(57) ABSTRACT

A fixing apparatus includes a fixing belt to fix an unfixed image on a sheet, an induction current generator configured to generate in the fixing belt an induction current that causes heating thereof, a shutdown unit disposed near a surface of the fixing belt and configured to cause shutdown of the fixing apparatus when a temperature of the shutdown unit reaches a first predetermined temperature, a temperature detecting unit disposed near the surface of the fixing belt and configured to detect a temperature at a location of the temperature detecting unit, and a control unit configured to turn off the induction current generator when the detected temperature reaches a second predetermined temperature that is smaller than the first predetermined temperature.

16 Claims, 7 Drawing Sheets

FIXING APPARATUS THAT CONTROLS POWER-ON AND POWER-OFF OF AN INDUCTION CURRENT GENERATOR AND IMAGE FORMING APPARATUS HAVING THE SAME

CROSS-REFERENCE TO RELATED APPLICATION

This application is based upon and claims the benefit of priority from Japanese Patent Application No. 2013-257992, filed Dec. 13, 2013, the entire contents of which are incorporated herein by reference.

FIELD

Embodiments described herein relate generally to a fixing apparatus and an image forming apparatus.

BACKGROUND

One type of a fixing apparatus has a heat generating layer in a fixing belt and causes heating of the heat generating layer by an induction heating (IH) method. A toner image is fixed on a recording medium when the recording medium having the toner image passes through the fixing belt.

Another type of the fixing apparatus has an automatic system to shutdown the fixing apparatus when a temperature of a fixing unit (e.g., fixing belt) is abnormally increased. In such a fixing apparatus, the system may erroneously shut down the fixing apparatus, even when the temperature of the fixing unit, as a whole, has not increased to an upper limit temperature. This erroneous shutdown of the fixing apparatus may occur, for example, when the temperature at a region of the fixing unit is locally increased more than the other regions as a result of the induction heating.

DETAILED DESCRIPTION

An embodiment provides a fixing apparatus and an image forming apparatus with a good operating efficiency that can prevent erroneous shutdowns of the apparatuses.

In general, according to one embodiment, a fixing apparatus includes a fixing belt to fix an unfixed image on a sheet, an induction current generator configured to generate in the fixing belt an induction current that causes heating thereof, a shutdown unit disposed near a surface of the fixing belt and configured to cause shutdown of the fixing apparatus when a temperature of the shutdown unit reaches a first predetermined temperature, a temperature detecting unit disposed near the surface of the fixing belt and configured to detect a temperature at a location of the temperature detecting unit, and a control unit configured to turn off the induction current generator when the detected temperature reaches a second predetermined temperature that is smaller than the first predetermined temperature.

Below, embodiments will be described.

First Embodiment

Figure 1:
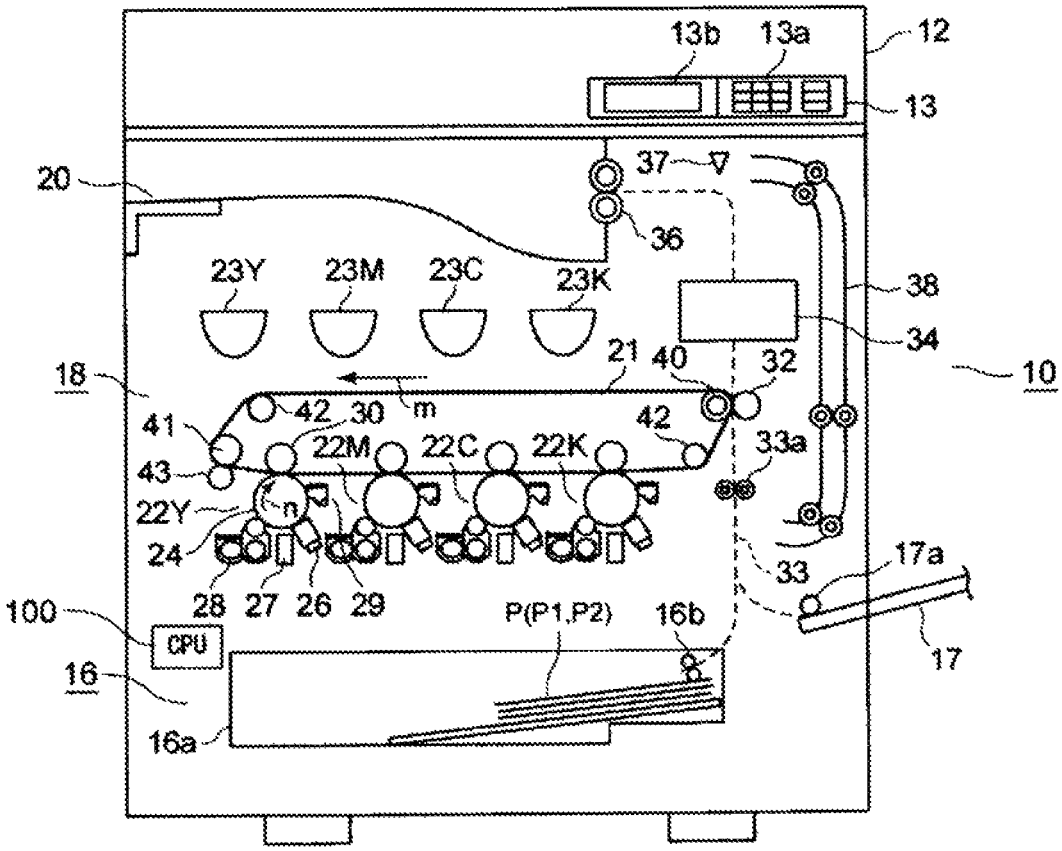
FIG. 1 illustrates an MFP including a fixing apparatus according to a first embodiment.

An image forming apparatus according to a first embodiment will be described with reference to FIGS. 1 to 7. FIG. 1 illustrates a multi-function peripheral (MFP) 10 that is an example of the image forming apparatus according to the first embodiment. The MFP 10 includes, for example, a scanner 12, a control panel 13, a paper cassette unit 16, a paper feeding tray 17, a printer unit 18, and a paper discharge unit 20. The MFP 10 includes a CPU 100 that controls the overall MFP 10 through a main body control circuit 101.

The scanner 12 scans an original image for forming an image with the printer unit 18. The control panel 13 includes, for example, input keys 13*a* and a touch panel display unit 13*b*. The input keys 13*a*, for example, receive inputs by a user. The display unit 13*b*, for example, receives inputs by a user or displays output user interfaces to the user.

The paper cassette unit 16 includes a paper cassette 16*a* that accommodates sheets P, which are recording media, and a pick-up roller 16*b* that conveys the sheets P out of the paper cassette 16*a*. The paper cassette 16*a* is able to feed new sheets P1 or reused sheets (for example, sheets having an image decolored in a decoloring process) P2 or the like. The paper feeding tray 17 is able to feed the new sheets P1 or the reused sheets P2 using the pick-up roller 17*a*.

The printer unit 18 includes an intermediate transfer belt 21. The printer unit 18 supports and rotates the intermediate transfer belt 21 in the direction of an arrow m in FIG. 1 with a backup roller 40 including a driving unit, a driven roller 41, and a tension roller 42.

The printer unit 18 includes four image forming stations 22Y, 22M, 22C, and 22K for yellow (Y), magenta (M), cyan (C), and black (K) disposed in parallel along a lower side of the intermediate transfer belt 21. The printer unit 18 includes supply cartridges 23Y, 23M, 23C, and 23K above each of the image forming stations 22Y, 22M, 22C, and 22K.

The supply cartridges 23Y, 23M, 23C, and 23K accommodate toners Y (yellow), M (magenta), C (cyan), and K (black) for supply, respectively.

For example, the Y (yellow) image forming station 22Y includes an electrostatic charger 26, an exposure scanning head 27, a developing apparatus 28, and a photoreceptor cleaner 29 on the periphery of a photoreceptor drum 24 that rotates in the direction of an arrow n. The Y (yellow) image forming station 22Y includes a primary transfer roller 30 at a position that faces the photoreceptor drum 24 with the intermediate transfer belt 21 therebetween.

The three image forming stations 22M, 22C, and 22K respectively for M (magenta), C (cyan), and K (black) include the same configuration as the Y (yellow) image forming station 22Y. The configurations of the three image forming stations 22M, 22C, and 22K will not be described in detail.

In each of the image forming stations 22Y, 22M, 22C, and 22K, the photoreceptor drum 24 is exposed to lights from the exposure scanning head 27 after being charged by the electrostatic charger 26, thereby forming an electrostatic latent image thereon. The developing apparatuses 28 develop the electrostatic latent image on the photoreceptor drums 24 using two-component developer formed of a carrier and one of Y (yellow), M (magenta), C (cyan), and K (black) toners. The toner used for the developer may be a non-decolorable toner or a decolorable toner.

The decolorable toner is a toner that is able to be decolored, for example, by being heated to a predetermined decoloring temperature or more. The decolorable toner, for example, contains a coloring material in a binder resin. The coloring material includes at least a coloring compound, a developer, and a decoloring agent. Components of the coloring material may be selected so that the coloring is erased at a given temperature or higher. The coloring material may be combined with a discoloration-temperature adjuster. When the toner image formed with the decolorable toner is heated to a predetermined decoloring temperature or higher, the toner image is decolored as the coloring compound and the developer in the decolorable toner break apart.

A well-known leuco dye such as a diphenylmethane phthalide can be used for the coloring compound, which configures the coloring material. The leuco dye is an electron donor compound able to develop color when combined with the developer.

The developer, which configures the coloring material, is an electron accepting compound that contributes a proton to the leuco dye, such as a phenol and a phenol metal salt.

It is possible to use a known compound for the decoloring agent in a three component system of the coloring compound, the developer, and the decoloring agent, as long as the decoloring agent, which configures the coloring material, is able to inhibit the coloring reaction between the coloring compound and the developer through heating and become uncolored. For example, an erasing agent using temperature hysteresis as a coloring and decoloring mechanism, such as an alcohol, an ester, or the like, has superior instant erasability. The coloring and decoloring mechanism in which temperature hysteresis is used is able to decolor the colored decolorable toner by the heating to a specified decoloring temperature or higher. For example, the decolorable toner is able to be fixed on a sheet at a comparatively low temperature, and decolored at a temperature, for example, approximately 10° C. higher than the fixing temperature.

There is no particular limit on the type of binder resin as long as the resin has a low melting point or a low glass transition temperature Tg so as to be able to be fixed at a lower temperature than the decoloring temperature of the coloring material mixed therewith. A polyester resin, a polystyrene resin or the like, for example, are available as the binder resin. These binder resins may be selected, as appropriate, to match the coloring material blended therewith.

Each of the primary transfer rollers 30 performs primary transfer of the toner image formed on the corresponding photoreceptor drum 24 to the intermediate transfer belt 21. The image forming stations 22Y, 22M, 22C, and 22K form a color toner image by sequentially overlapping Y (yellow), M (magenta), C (cyan), and K (black) toner images on the intermediate transfer belt 21 with the primary transfer roller 30. The photoreceptor cleaner 29 removes toner remaining on the photoreceptor drum 24 after the primary transfer.

The printer unit 18 includes a secondary transfer roller 32 at a position that faces the backup roller 40 with the intermediate transfer belt 21 disposed therebetween. The secondary transfer roller 32 collectively performs secondary transfer of the color toner image on the intermediate transfer belt 21 to the sheet P. The sheet P is supplied from the paper cassette unit 16 or the manual paper feeding tray 17 along a conveyance path 33 in synchronization with the color toner image conveyed on the intermediate transfer belt 21. A belt cleaner 43 removes toner remaining on the intermediate transfer belt 21 after the secondary transfer. The intermediate transfer belt 21, the four image forming stations 22Y, 22M, 22C, and 22K, and the secondary transfer roller 32 configure the image forming unit.

The printer unit 18 includes a resist roller 33*a*, a fixing apparatus 34, and a discharge roller 36 along the conveyance path 33. The printer unit 18 includes a branching unit 37 and a revere transport unit 38 downstream of the fixing apparatus 34. The branching unit 37 guides the sheet P after the fixing to the paper discharge unit 20 or to the revere transport unit 38. If duplex printing is performed, the revere transport unit 38 reversely transports the sheet P guided by the branching unit 37 in the direction of the resist roller 33*a*. According to this configuration, the MFP 10 forms a fixed toner image on the sheet P with the printer unit 18 and discharges the sheet P to the paper discharge unit 20.

The image forming apparatus is not limited to a tandem type, and the number of developing apparatuses is also not limited. The imaging forming apparatus may directly transfer the toner image to the recording medium from the photoreceptor. The image forming apparatus may include a printer unit that forms an image with a non-decolorable toner and a printing portion that forms an image with a decolorable toner.

Figure 2:
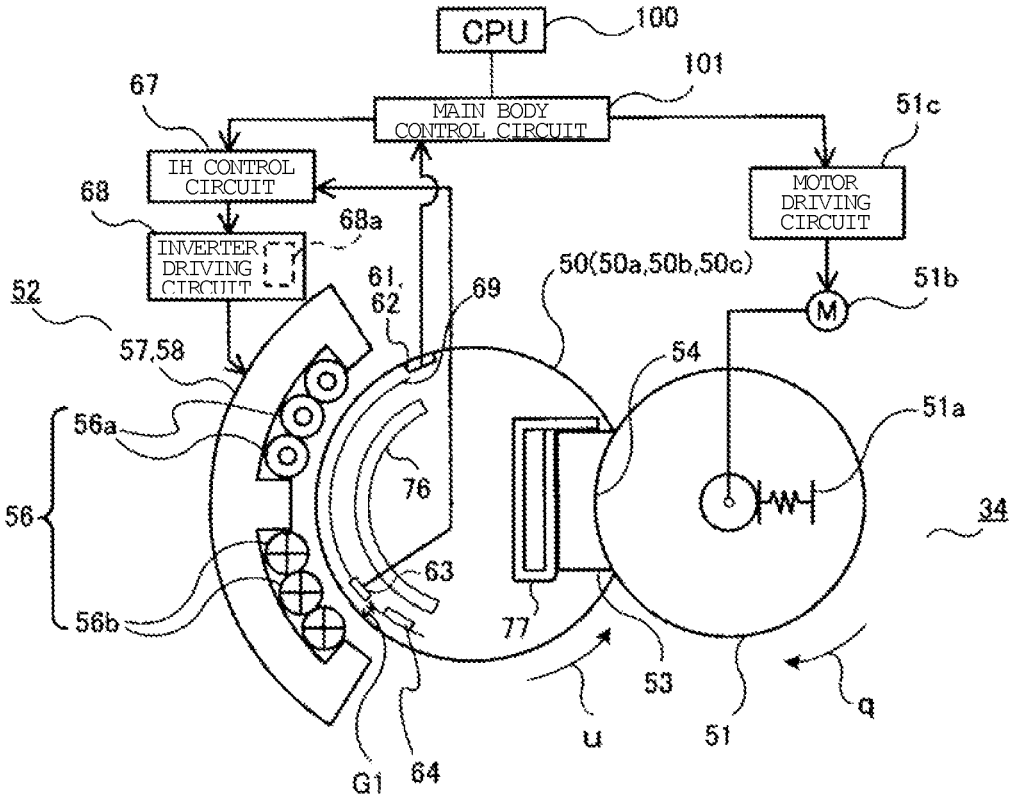
FIG. 2 illustrates components of the fixing apparatus according to the first embodiment.

Next, the fixing apparatus 34 will be described in detail. As illustrated in FIG. 2, the fixing apparatus 34 includes a fixing belt 50, a press roller 51, and an electromagnetic induction heating coil unit (hereinafter, IH coil unit) 52, which is an induction current generator. The fixing belt 50 includes a nip pad 53, an auxiliary heat generating plate 69, and a shield 76 in the interior thereof. Within a space formed in the fixing belt 50, a center thermistor 61, an edge thermistor 62, and a bimetal-type thermostat 63, which is a blocking unit, are disposed. The fixing belt 50 includes a third thermistor 64, which is a safe temperature detector, and a stay 77 that supports the nip pad 53.

The fixing belt 50 is driven by the press roller 51 or rotates independently in the direction of an arrow u. The fixing belt 50 is formed, for example, by sequentially layering a heat generating layer 50*a* of non-magnetic metal copper (Cu), which is a heat generating unit, and a release layer 50*c* of a fluororesin on abase layer 50*b* of polyimide (PI) resin. The fixing belt 50 has a low heat capacity as the heat generating layer 50*a* is thin so as to be able to warm up quickly. The fixing belt 50 with such a low heat capacity can shorten the time necessary for warming up and reduces energy consumption.

To reduce the heat capacity of the fixing belt 50, a thickness of the heat generating layer 50*a* of copper (Cu) is, for example, 10 μm. The heat generating layer 50*a* of the fixing belt 50 may include, for example, a protective film of nickel (Ni) or the like in order to prevent oxidation of the heat generating layer 50*a*. The protective film of nickel (Ni) or the like prevents oxidation of the heat generating layer 50*a* and improves the mechanical strength of the heat generating layer 50*a*.

The fixing belt 50 is formed by plating copper (Cu) after being subjected to electroless nickel (Ni) plating as a heat generating layer 50*a* on a base layer 50*b* formed from a polyimide (PI) resin. The fixing belt 50 increases the adhesion strength between the base layer 50*b* and the heat generating layer 50*a* and increases the mechanical strength of the heat generating layer 50*a* by being subjected to electroless nickel (Ni) plating.

The surface of the base layer 50*b*, which is formed of polyimide (PI) resin, may be roughened by sandblasting or chemical etching in order to further mechanically increase the adhesion strength between the base layer 50*b* and the heat generating layer 50*a*, which is formed by the nickel (Ni) plating. The fixing belt 50 may include a metal such as titanium (Ti) dispersed in the polyimide (PI) resin of the base layer 50*b* in order to further increase the adhesion strength between the base layer 50*b* and the heat generating layer 50*a* formed by the nickel (Ni) plating.

The heat generating layer 50*a* of the fixing belt 50 may be formed of, for example, nickel (Ni), iron (Fe), stainless steel, aluminum (Al), silver (Ag), or the like. The heat generating layer 50*a* may include two or more types of alloy, or may have a structure in which two or more layers of metal are overlapped. An eddy current is caused in the heat generating layer 50*a* by magnetic flux generated by the IH coil unit 52, and the heat generating layer 50*a* generates Joule heat due to the eddy current flowing through the heat generating layer 50*a* serving as a resistor, and the fixing belt 50 is heated by the generated heat. The layer structure is not limited as long as the fixing belt 50 includes a heat generating layer 50*a*.

Figure 3:
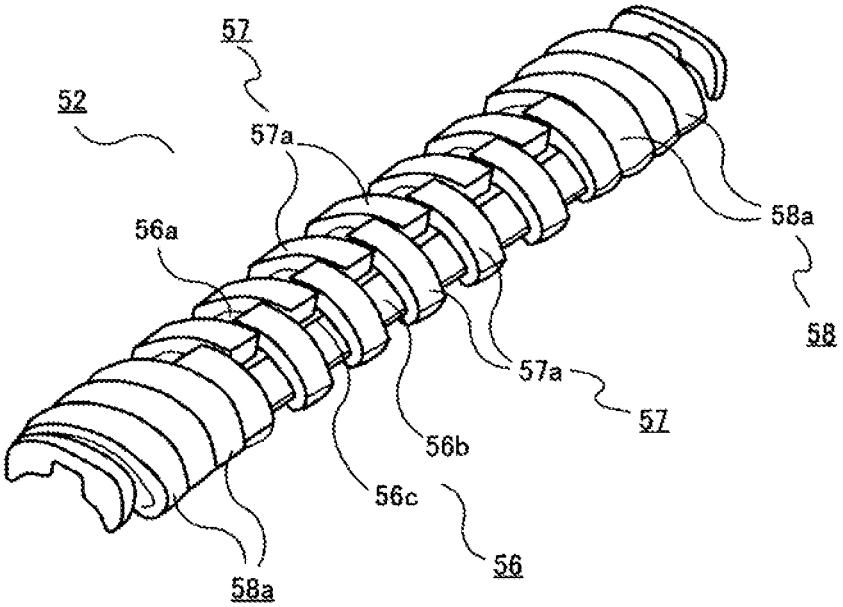
FIG. 3 illustrates an IH coil unit of the fixing apparatus according to the first embodiment.

The IH coil unit 52 includes a coil 56, which is a magnetic flux generator, as illustrated in FIG. 3. The IH coil unit 52 also includes a first core 57 that concentrates magnetic flux from the coil 56 by alternately regulating the magnetic flux generated by the coil 56 in the direction of the fixing belt 50 one wing at a time. The IH coil unit 52 also includes a second core 58 that concentrates the magnetic flux from the coil 56 in the direction of the fixing belt 50 by regulating both wings of the magnetic flux generated by the coil 56 on both sides of the first core 57. The IH coil unit 52 generates an induction current in the heat generating layer 50*a* of the fixing belt 50 facing the IH coil unit 52 while the fixing belt 50 rotates in the direction of the arrow u. The magnetic flux concentration of the second core 58 of the IH coil unit 52 is made greater than the magnetic flux concentration of the first core 57, and prevents the temperature at both ends of the fixing belt 50 from dropping.

For example, litz wires is used for the coil 56, in which a plurality of copper wires coated by a heat resistant polyamide-imide that is an insulating material are overlapped. The coil 56 includes a wound-up conductive wires, and a window section 56*c* is formed in the center of the left and right wings 56*a* and 56*b*. The center of the window section 56*c* is the center of the coil 56 in the longitudinal direction. The coil 56 generates magnetic flux by the application of a high-frequency current from an inverter driving circuit 68. The inverter driving circuit 68 includes, for example, an insulated gate bipolar transistor (IGBT) element 68*a*. The structure of the IH coil unit 52 is not limited.

The auxiliary heat generating plate 69 is formed in a circular arc shape and disposed along the inner peripheral surface of the fixing belt 50 with a gap G1 spaced with the inner peripheral surface of the fixing belt 50. The auxiliary heat generating plate 69 includes a member having magnetic characteristics, such as iron (Fe) and nickel (Ni). The auxiliary heat generating plate 69 may be formed of a resin or the like that includes a magnetic powder if the resin, as a whole, shows magnetic characteristics. The auxiliary heat generating member is not limited to a plate form, and may be formed as a magnetic member having the thickness of a magnetic core or the like.

The auxiliary heat generating plate 69 generates heat through an eddy current caused by the magnetic flux generated by the IH coil unit 52. The auxiliary heat generating plate 69 assists the heating of the fixing belt 50 by the heat generating layer 50*a* of the fixing belt 50 using the IH coil unit 52. The gap G1 between the auxiliary heat generating plate 69 and the fixing belt 50 prevents the heat generated at the auxiliary heat generating plate 69 being directly conducted to the fixing belt 50.

Figure 4:
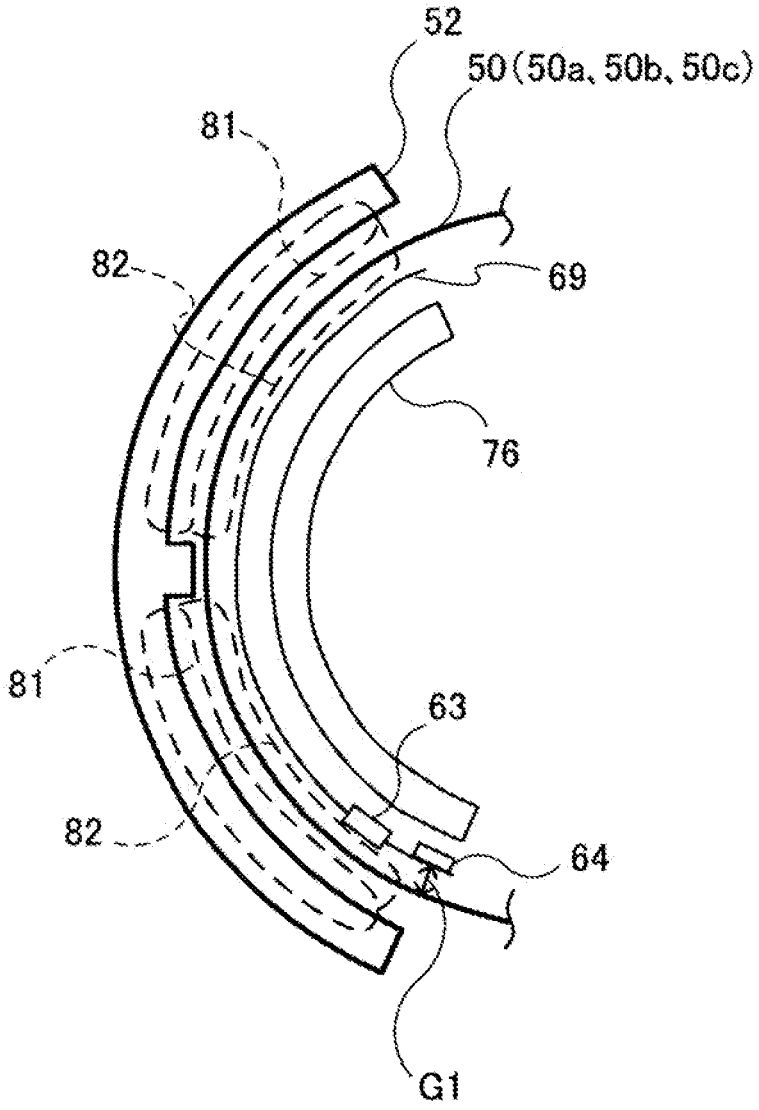
FIG. 4 illustrates a magnetic circuit passing through a fixing belt and an auxiliary heat generating plate of the fixing apparatus due to the magnetic flux generated by the IH coil.

As illustrated in FIG. 4, the magnetic flux generated by the IH coil unit 52 forms a first magnetic circuit 81 in the heat generating layer 50*a* of the fixing belt 50. The magnetic flux generated by the IH coil unit 52 further forms a second magnetic circuit 82 in the auxiliary heat generating plate 69.

The auxiliary heat generating plate 69 generates heat due to the magnetic flux generated by the IH coil unit 52, assists the heating of the fixing belt 50 by the heat generating layer 50*a* of the fixing belt 50 during warming up of the fixing belt 50, and accelerates the warming up. The auxiliary heat generating plate 69 assists the heating of the fixing belt 50 by the heat generating layer 50*a* of the fixing belt 50 also during printing, and maintains the fixing temperature.

Figure 5:
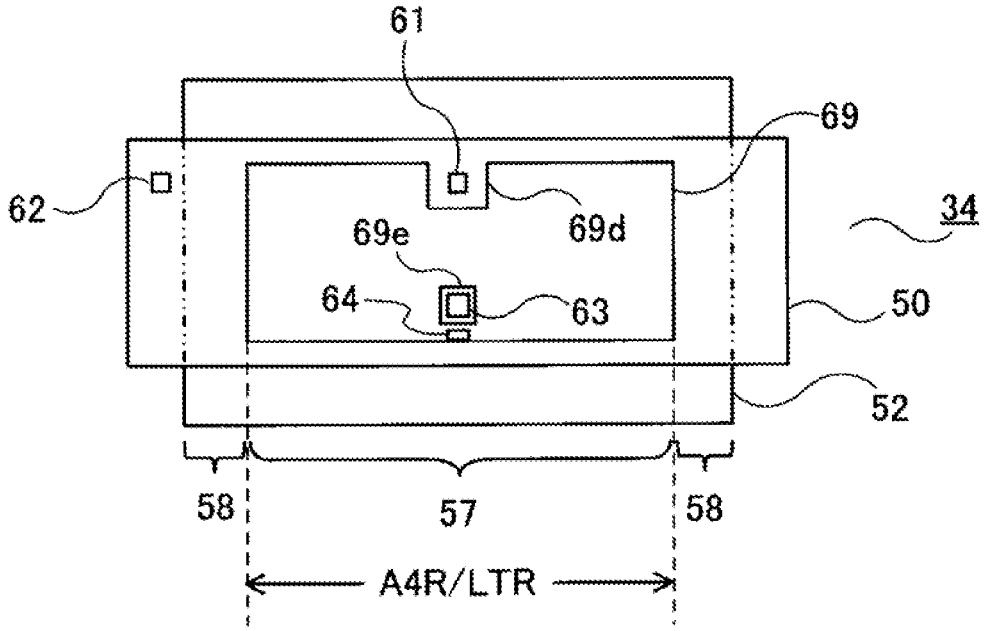
FIG. 5 illustrates the auxiliary heat generating plate, the fixing belt, and the IH coil unit viewed from the auxiliary heat generating plate side.
Figure 6:
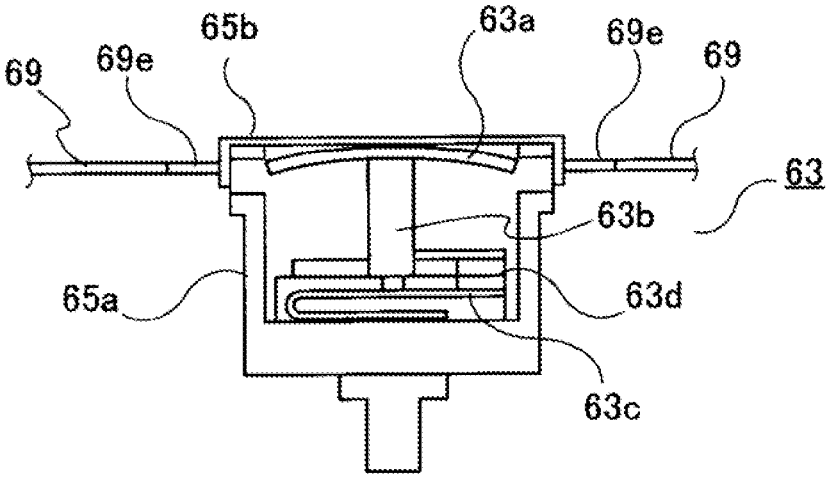
FIG. 6 illustrates a thermostat of the fixing apparatus according to the first embodiment.

As illustrated in FIG. 5, the auxiliary heat generating plate 69, for example, is formed with a width that covers a JIS standard A4R size and letter size area, and is formed with approximately the same width as the disposition region of the first core 57 of the IH coil unit 52. The auxiliary heat generating plate 69 forms an edge notch section 69*d* at a position (approximate center position in the width direction of the auxiliary heat generating plate 69) corresponding to the center thermistor 61. The notch section 69*d* prevents heat generated by the auxiliary heat generating plate 69 from influencing the detection results of the center thermistor 61.

The shield 76 is formed of a non-magnetic member such as aluminum (Al) or copper (Cu). The shield 76 shields the magnetic flux from the IH coil unit 52, and prevents the magnetic flux from influencing the stay 77 or the nip pad 53, or the like, inside the fixing belt 50.

The nip pad 53 presses inner peripheral surface of the fixing belt 50 towards the press roller 51, thereby forming a nip 54 between the fixing belt 50 and the press roller 51. The nip pad 53 is formed from, for example, a heat resistant polyphenylene sulfide resin (PPS), a liquid crystal polymer (LCP), a phenol resin (PF) or the like. The nip pad 53 includes a sheet with good slidability and good friction resistance between a main part of the heat resistant fixing belt 50 and the nip pad 53 or includes a release layer formed from a fluororesin therebetween. The frictional resistance between fixing belt 50 and the nip pad 53 can be reduced by the sheet or the release layer.

The press roller 51 includes a heat resistant silicon sponge or silicon rubber layer or the like on the periphery of a cored bar thereof, and includes a release layer formed from a fluorine resin, such as a PFA resin, on the surface thereof. The press roller 51 applies pressure to the nip pad 53 at a high pressure through the pressure mechanism 51*a*. The press roller 51 rotates in the direction of an arrow q due to a motor 51*b* operated by the motor driving circuit 51*c* controlled by the main body control circuit 101.

The center thermistor 61 and the edge thermistor 62 detect the temperature of the fixing belt 50, and input the result to the main body control circuit 101. The center thermistor 61 is disposed at the approximate center in the width direction of the fixing belt 50. Because of the notch section 69*d* of the auxiliary heat generating plate 69, the center thermistor 61 is not subject to the influence of the heat generated at the auxiliary heat generating plate 69 and detects the temperature of the center region of the fixing belt 50 with high precision.

The edge thermistor 62 is disposed at a position outside the IH coil unit 52 in the width direction of the fixing belt 50. The edge thermistor 62 can detect the temperature of the edge region of the fixing belt 50 with high precision.

The CPU 100 controls the main body control circuit 101 and the IH control circuit 67 based on the detection results of the center thermistor 61 and the edge thermistor 62 of the fixing belt 50, so that the magnitude of the high-frequency current output by the inverter driving circuit 68 is controlled. The temperature of the fixing belt 50 holds various control temperature ranges according to the output of the inverter driving circuit 68.

The thermostat 63 functions as a safety device for the fixing apparatus 34. The thermostat 63 operates when the fixing belt 50 generates abnormal heat and the temperature rises to a predetermined threshold value. At this time, the current to the IH coil unit 52 is blocked by the operation of the thermostat 63, and the MFP 10 is shut down (driving is stopped) to prevent abnormal heat generation by the fixing apparatus 34 from continuing.

The thermostat 63, for example, detects the temperature of the fixing belt 50 around the center notch section 69*e* formed in the approximate center of the auxiliary heat generating plate 69. The thermostat 63, which is of a bimetal-type, has a structure illustrated in FIG. 6. The thermostat 63 includes a bimetal 63*a* having two types of metal bonded together, a pin 63*b*, a spring 63*c*, and a contact point 63*d* in a case 65*a*, and is sealed with an aluminum cap 65*b*.

In the thermostat 63, the deformation of the bimetal 63*a* causes the pin 63*b* to slide, the sliding of the pin 63*b* pushes the spring 63*c*, and then the spring 63*c* is separated from the contact point 63*d*. When the spherical shape of the bimetal 63*a* is reversed in the state in which the contact point 63*d* is in contact with the spring 63*c*, the bimetal 63*a* pushes the pin 63*b* down, thereby separating the contact point 63*d* from the spring 63*c*. When the temperature of the fixing belt 50 reaches the threshold value due to abnormal heat generation, exceeding the temperature able to be safely held, the spherical shape of the bimetal 63*a* of the thermostat 63 is reversed and operates so as to separate the contact point 63*d* from the spring 63*c*. The current to the IH coil unit 52 is blocked by the separation of the contact point 63*d* of the thermostat 63 from the spring 63*c*, and the MFP 10 is able to be safely shut down.

In the manufacturing of the fixing belt 50, because the surface of the base layer 50*b* is roughened in order to raise the adhesion with the heat generating layer 50*a*, it is hard to form the copper (Cu) layer or the nickel (Ni) layer of the heat generating layer 50*a* to be uniform and thin. Thus, the thickness of the heat generating layer 50*a* of the fixing belt 50 may be locally uneven. When the film thickness of the heat generating layer 50*a* of the fixing belt 50 is uneven, the temperature of the fixing belt 50 may locally become higher at the thin region of the heat generating layer 50*a*. When the thickness of the heat generating layer 50*a* of the fixing belt 50 at the region facing the thermostat 63 is locally thin, the thermostat 63 operating and the MFP 10 may be shut down even if the fixing belt 50 does not abnormally generate heat.

When the thickness of the heat generating layer 50*a* at the region facing the thermostat 63 is thin, the aluminum cap 65*b* or the bimetal 63*a* self-generates heat due to the magnetic flux from the IH coil unit 52, and the thermostat 63 may be mis-operated. On the other hand, when the heat generating layer 50*a* of the fixing belt 50 is thick, the thermostat 63 self-generating heat becomes extremely minute due to the shielding effects by the heat generating layer 50*a*. However, in a region in which the heat generating layer 50*a* is locally thin, the shielding effect of the magnetic flux due to the heat generating layer 50*a* decreases, and the risk of the malfunction of thermostat 63 caused by self-generated heat increases.

The frequency of the shutdown of the MFP 10 increases when the temperature of fixing belt 50 locally exceeds the threshold value or the thermostat 63 self-generates heat caused by the thin heat generating layer 50*a* of the fixing belt 50. In order to reduce the frequency of the shutdown, a third thermistor 64 is disposed within the region of the auxiliary heat generating plate 69.

The third thermistor 64 contacts the auxiliary heat generating plate 69 at a position separated from the heating region (region in which an eddy current occurs due to the magnetic flux generated by the IH coil unit 52) of the IH coil unit 52, which is at substantially the same location as the position of the thermostat 63 in the rotational direction of the fixing belt 50. The third thermistor 64 detects the temperature of the region of the fixing belt 50 that faces the thermostat 63.

The position of the third thermistor 64 is not limited to the substantially same location as the position of the thermostat 63. If the layer thickness distribution of the heat generating layer 50*a* of the fixing belt 50 is specified, the third thermistor 64 may be disposed at a position that faces a region in which the heat generating layer 50*a* is thin compared to a region that faces the thermostat 63.

The third thermistor 64 inputs the detection results to the main body control circuit 101. If the detection results of the third thermistor 64 are a predetermined upper limit temperature or higher, the CPU 100 switches an operational state of the MFP 10 to a standby (wait) mode, and awaits a print operation of the MFP 10. The CPU 100 stops the power supply to the IH coil during the standby mode. When the detection results of the third thermistor 64 are a lower limit temperature or lower, the CPU 100 switches the operational state of the MFP 10 to the print mode.

The upper limit temperature for switching the MFP 10 to standby mode is set to a temperature which is lower than the threshold value for the thermostat 63 and at which the thermostat 63 does not operate even when the thermostat 63 self-generates heat. The upper limit temperature is set based on the maximum value of the difference between the threshold value set in advance for the thermostat 63 and the temperature at which the thermostat 63 operates because of the self-generated heat. For example, if the maximum value of the difference between the threshold value set in advance for the thermostat 63 and the operating temperature by the self-generated heat is 20° C., the upper limit temperature is set to a temperature 25° C. lower than the threshold value. For example, if the threshold value for the thermostat 63 is 240° C., the upper limit temperature for setting the print operation of the MFP 10 to standby mode is set to 215° C. The lower limit temperature at which the MFP 10 is switched from standby mode to print mode is set to, for example, 180° C. with respect to the upper limit temperature of 215° C. The threshold value of the thermostat 63 and the upper limit temperature for setting the print operation of the MFP 10 to standby mode are not limited.

The third thermistor 64 causes the operational state of the MFP 10 to be switched to the standby mode before the thermostat 63 operates even when the fixing belt 50 does not abnormally generate heat that is caused by the thin heat generating layer 50*a*. Switching the operational state of the MFP 10 to a standby mode beforehand, operating and frequent shutdown of the MFP 10 caused by the malfunction of the thermostat 63 can be avoided.

Figure 7:
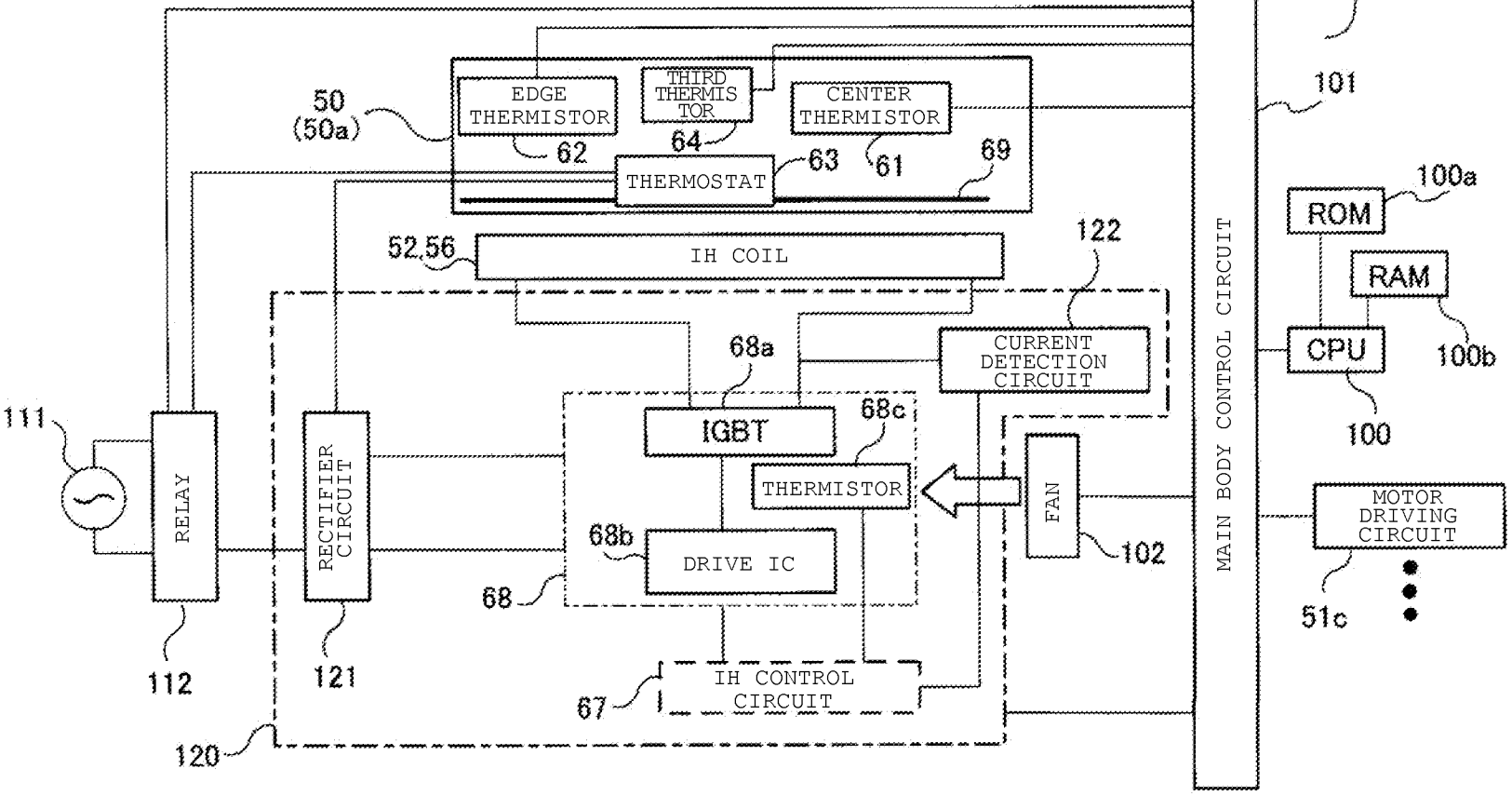
FIG. 7 illustrates a control system of the IH coil unit of the fixing apparatus according to the first embodiment.

The control system 110 that mainly controls the IH coil unit 52 that causes generation of heat in the fixing belt 50 will be described in detail with reference to FIG. 7. The control system 110 includes the CPU 100 that controls the overall MFP 10, a read-only memory (ROM) 100*a*, a random access memory (RAM) 100*b*, the main body control circuit 101, the IH circuit 120, and a motor driving circuit 51*c*. The control system 110 supplies power to the IH coil unit 52 through the IH circuit 120. The IH circuit 120 includes a rectifier circuit 121, an IH control circuit 67, an inverter driving circuit 68, and a current detection circuit 122.

In the IH circuit 120, the rectifier circuit 121 rectifies a current input from a common AC power source 111 via a relay 112, and the rectified current is supplied to the inverter driving circuit 68. The relay 112 blocks the current from the common AC power source 111 when the thermostat 63 cuts off the connection. The inverter driving circuit 68 includes a drive IC 68*b* of the IGBT element 68*a* and a thermistor 68*c*. The thermistor 68*c* detects the temperature of the IGBT element 68*a*. When the thermistor 68*c* detects a temperature rise of the IGBT element 68*a*, the main body control circuit 101 drives the fan 102 to cool down the IGBT element 68*a*.

The IH control circuit 67 controls the output of the IGBT element 68*a* through the drive IC 68*b* according to the detection results of the center thermistor 61 and the edge thermistor 62. The current detection circuit 122 detects the output of the IGBT element 68*a*, and provides feedback to the IH control circuit 67. The IH control circuit 67 feedback controls the drive IC 68*b* so that the supplied power to the coil 56 is constant, according to the detection results of the current detection circuit 122.

The CPU 100 controls the IH circuit 120, the motor driving circuit 51*c*, and the like through the main body control circuit 101 according to the detection results of the third thermistor 64, and sets the MFP 10 to the standby mode or to a print mode.

During Warming Up

When the MFP 10 is turned on, various detection devices, such as the center thermistor 61, the edge thermistor 62, and the third thermistor 64, perform the respective detection operations thereof. During warming up after the MFP 10 is turned on, the fixing apparatus 34 rotates the press roller 51 in the direction of the arrow q and the fixing belt 50 is driven to rotate in the direction of the arrow u. The IH coil unit 52 generates a magnetic flux in the direction of the fixing belt 50 through application of a high-frequency current by the inverter driving circuit 68.

The magnetic flux of the IH coil unit 52 is induced in the first magnetic circuit 81 that passes through the heat generating layer 50*a* of the fixing belt 50, and causes heat in the heat generating layer 50*a*. The magnetic flux of the IH coil unit 52 passing through the fixing belt 50 is induced in the second magnetic circuit 82 that passes through the auxiliary heat generating plate 69, and causes heat in the auxiliary heat generating plate 69.

The heat generated in the auxiliary heat generating plate 69 is conducted to the fixing belt 50 via the gap G1. The heat conducted from the auxiliary heat generating plate 69 to the fixing belt 50 promotes a rapid increase in the temperature of the fixing belt 50. During the warming up, the IH control circuit 67 feedback controls the driving circuit inverter based on the detection results of the center thermistor 61 or the edge thermistor 62. The fixing belt 50 in which the heat generating layer 50*a* is thin and has a low heat capacity can make the warming up finish in a short period.

During Fixing Operation

When the fixing belt 50 reaches the fixing temperature and then finishes warming up, the MFP 10 starts the print operation if there is a print request. The printer unit 18 of the MFP 10 forms a toner image on the sheet P, and the sheet P is conveyed in the direction of the fixing apparatus 34.

The MFP 10 passes the sheet P on which the toner image is formed through the nip 54 between the fixing belt 50 which reaches the fixing temperature and the press roller 51, and fixes the toner image to the sheet P with heat and pressure applied thereto. While performing the fixing, the IH control circuit 67 holds the fixing belt 50 at the fixing temperature by feedback controlling the IH coil unit 52.

The fixing belt 50 loses heat to the sheet P during the fixing operation. Because the amount of heat lost from the fixing belt 50 during continuous paper feeding at high speed is large, there is concern that the fixing temperature may not be held by the fixing belt 50 if the fixing belt 50 has a low heat capacity. The heat conducted from the auxiliary heat generating plate 69 to the fixing belt 50 heats the fixing belt from the inner periphery of the fixing belt 50, and compensates for the insufficient heat required for the fixing belt 50. The fixing belt 50 is heated by heat conducted from the auxiliary heat generating plate 69 to the fixing belt 50, even during continuous paper feeding at high speeds, and the temperature of the fixing belt 50 can be held at the fixing temperature.

When Temperature of Fixing Belt 50 Rises Excessively

When the MFP 10 is on, the fixing belt 50 may exceed the acceptable temperature range to an abnormal temperature due to a defect or the like. Alternatively, a region of the heat generating layer 50*a* of the fixing belt 50 that faces the thermostat 63 is locally thin, and the region of the fixing belt 50 facing the thermostat 63 may rise excessively locally in temperature. When the fixing belt 50 rises excessively in temperature, the CPU 100 ceases the print operation of the MFP 10 according to the temperature detection results of the third thermistor 64, and thereafter recovers to the print mode. When the fixing belt 50 rises in temperature and abnormally generates heat even after having ceased the print operation of the MFP 10, the thermostat 63 operates and the MFP 10 is entirely shut down.

The CPU 100 awaits the print operation of the MFP 10 when the detected temperature by the third thermistor 64 is 220° C. or more, exceeding the acceptable temperature ranges of the fixing belt 50. The main body control circuit 101 controls the IH circuit 120 and the motor driving circuit 51*c* or the like, and sets the operational mode of the MFP 10 to the standby mode. When the temperature of the fixing belt 50 is lowered during the standby mode and the detected temperature of the third thermistor 64 is 180° C. or lower, the CPU 100 switches the operational mode of the MFP 10 back to the print mode. When the temperature of the fixing belt 50 rises locally, the risk of the frequent shut down of the MFP 10 caused by the thermostat 63 operating in response to the local rise of the temperature can be avoided. Further, when the temperature of the fixing belt 50 does not reach the threshold value of the thermostat 63, the risk of the frequent shut down of the MFP 10 caused by the malfunction of the thermostat 63 can be avoided.

When the fixing belt 50 further rises in temperature and abnormally generates heat after the MFP 10 is set to the standby mode, the thermostat 63 operates. The thermostat 63 separates the contact point 63*d* from the spring 63*c*, and the MFP 10 is shut down by the current flowing from the commercial AC power source 111 to the rectifier circuit 121 via the relay 112 being blocked. The power supply to the IH coil unit 52 from the IH control circuit 67 is blocked by the operation of the thermostat 63, the fixing apparatus 34 stops generating heat, achieving the protection of the fixing apparatus 34 and the MFP 10. By setting the MFP 10 to the standby mode before the thermostat 63 operates, the risk of the MFP 10 being shut down can be avoided.

According to the first embodiment, the heat capacity of the fixing belt 50 is low as the heat generating layer 50*a* is thin, the warming up period is short, and energy consumption is low. The auxiliary heat generating plate 69 is disposed apart from the inner periphery of the fixing belt 50 with a gap G1, thereby assisting the heating of the fixing belt 50, accelerating the warming up period, and saving the consumed energy. The fixing temperature during the fixing is maintained due to the assist of the heating of the fixing belt 50 by the auxiliary heat generating plate 69, and as a result a satisfactory fixing capability can be obtained.

According to the first embodiment, a third thermistor 64 that prevents MFP 10 from frequently being shut down is disposed; the shutdown of the MFP 10 may be caused by an operation of the thermostat 63 in response to the temperature of the fixing belt 50 rising excessively locally caused by a locally thin portion of the heat generating layer 50*a* of the fixing belt 50. The third thermistor 64 is disposed on approximately the same location as the position of the thermostat 63 of the auxiliary heat generating plate 69. The CPU 100 sets the operational mode of the MFP 10 to the standby mode according to the detected temperature of the third thermistor 64 before the thermostat 63 operates. The operation of the thermostat 63 when the temperature of the fixing belt 50 rises excessively is avoided, and the frequent shutdown of the MFP 10 is avoided, thereby improving the operation efficiency of the MFP 10. When the fixing belt 50 abnormally generates heat after the operational mode of the MFP 10 is set to the standby mode, the MFP 10 is shut down by the operation of the thermostat 63, and thereby the MFP 10 can be protected from the abnormal heat.

Second Embodiment

The fixing apparatus according to the second embodiment will be described with reference to FIGS. 8 to 10. The second embodiment includes a magnetic shunt alloy layer and an auxiliary heat generating plate inside the fixing belt according to the first embodiment. The magnetic shunt alloy layer and the auxiliary heat generating plate assist the heating of the fixing belt. In the second embodiment, the same reference numerals will be used for the same components as those described in the first embodiment, and a detailed description thereof will not be repeated.

Figure 8:
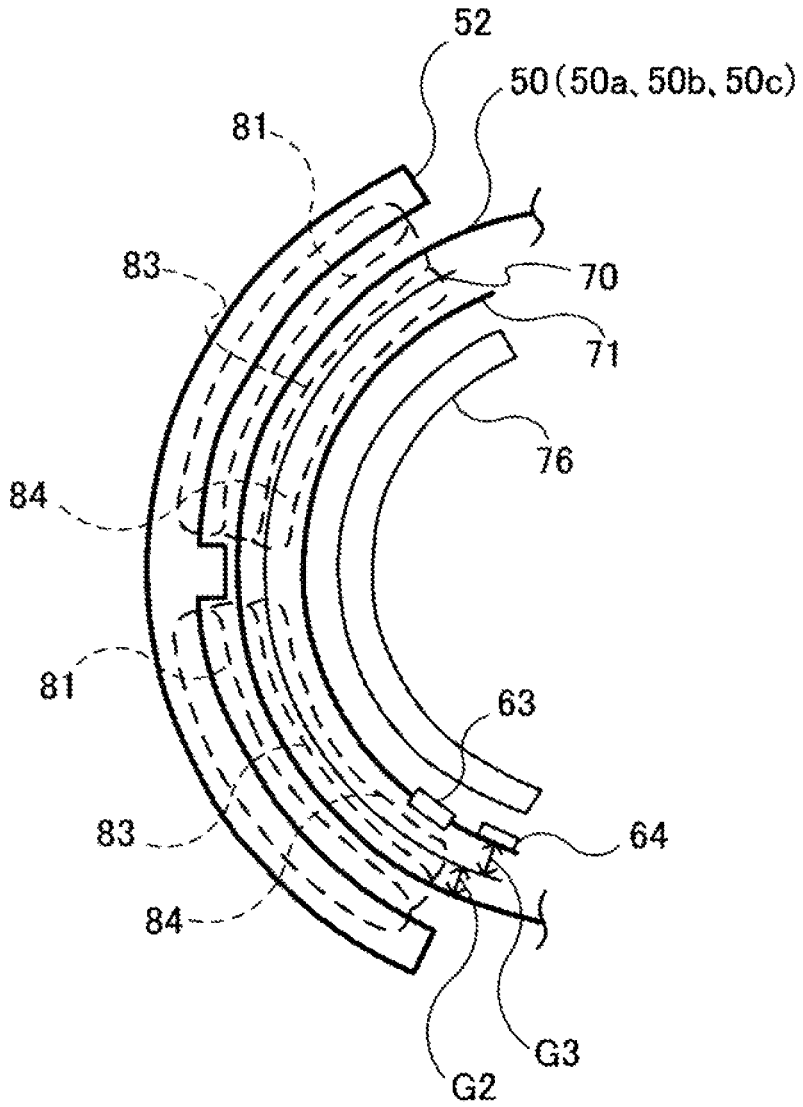
FIG. 8 illustrates a magnetic circuit passing through a fixing belt, a magnetic shunt alloy layer, and an auxiliary heat generating plate due to the magnetic flux generated by an IH coil unit of a fixing apparatus according to a second embodiment.

The second embodiment includes the magnetic shunt alloy layer 70 and the auxiliary heat generating plate 71, which is an auxiliary heat generating unit, between the fixing belt 50 and the shield 76 as illustrated in FIG. 8. The magnetic shunt alloy layer 70 is formed in a circular arc shape and disposed along the inner peripheral surface of the fixing belt 50 with a gap G2 between the magnetic shunt alloy layer 70 and the inner peripheral surface of the fixing belt 50. The magnetic shunt alloy layer 70 is formed from a magnetic shunt ally member with a Curie temperature Tc lower than the threshold value of the thermostat 63, and suppresses an excessive temperature rise in the fixing belt 50.

Figure 9:
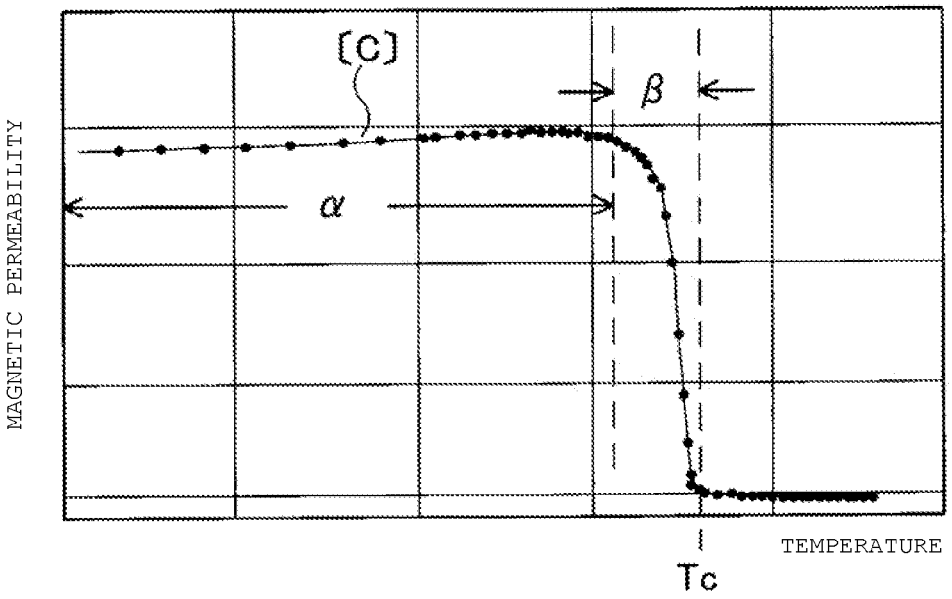
FIG. 9 is a graph describing the magnetic characteristics of a magnetic shunt alloy layer of the fixing apparatus according to the second embodiment.

The magnetic characteristics of the magnetic shunt alloy member vary significantly around the Curie temperature Tc, as shown by the solid line C in FIG. 9. The Curie temperature Tc of the magnetic shunt alloy member varies depending on the material thereof. The magnetic shunt alloy member shows the characteristics of a ferromagnetic body with a high magnetic permeability in the low temperature range α, and the magnetic permeability increases along with an increase in the temperature. The magnetic permeability of the magnetic shunt alloy member significantly decreases as the rise in temperature in a transition range β, which is close to the Curie temperature Tc. The magnetic shunt alloy member shows the characteristics of a paramagnetic body in which the magnetic permeability is substantially zero at a temperature above the Curie temperature Tc, and does not generate an induction current.

The magnetic shunt alloy layer 70 is formed of an iron-nickel magnetic shunt alloy member having a Curie temperature Tc of 200° C. If a temperature of the magnetic shunt alloy layer 70 is within the low temperature range α, which is lower than the Curie temperature Tc, the magnetic shunt alloy layer 70 shows the characteristics of a ferromagnetic body, and generates heat with the induction current caused by the magnetic flux generated by the IH coil unit 52. Thus, the magnetic shunt alloy layer 70 at a temperature in the low temperature range αgenerates heat due to the heat generating layer 50*a* of the fixing belt 50 using the IH coil unit 52 and can assist the heating of the fixing belt 50. The magnetic shunt alloy layer 70 in the low temperature range αaccelerates the increase in the temperature of the fixing belt 50 during the warming up of the MFP 10, and contributes to more reliably maintain the fixing temperature during the printing by the MFP 10.

The magnetic shunt alloy layer 70 ceases heat generation when its temperature reaches the Curie temperature Tc passing through the transition range β, and suppresses the temperature of the fixing belt 50 from becoming too high. When the magnetic shunt alloy layer 70 reaches the Curie temperature Tc (e.g., when temperature at the non-paper feeding region of the fixing belt 50 rises when plural sheets are continuously fed), the magnetic shunt alloy layer 70 ceases heat generation and therefore can suppress the temperature of the fixing belt 50 from rising further. The magnetic shunt alloy layer 70 is reversible, and when the temperature of the magnetic shunt alloy layer 70 decreases to less than the Curie temperature Tc, the magnetic shunt alloy layer 70 shows the characteristic of the paramagnetic body again.

The material of the magnetic shunt alloy layer, the Curie temperature, and the like are not limited. The magnetic shunt alloy layer 70 may be any material having a Curie temperature Tc that is higher than the toner fixing temperature, and lower than heat resistance temperature of the fixing belt 50 (e.g., approximately 200° C.)

The auxiliary heat generating plate 71 is formed in a circular arc shape and disposed along the inner peripheral surface of the magnetic shunt alloy layer 70 with a gap G3 between the auxiliary heat generating plate 71 and the inner peripheral surface of the magnetic shunt alloy layer 70. The auxiliary heat generating plate 71, for example, is configured with a member that includes magnetic characteristics, such as iron (Fe) and nickel (Ni). The auxiliary heat generating plate 71 shows constant magnetic characteristics, regardless of the temperature of the auxiliary heat generating plate 71.

The auxiliary heat generating plate 71 generates heat through an eddy current caused by magnetic flux generated by the IH coil unit 52. The auxiliary heat generating plate 71 contributes to the heating of the fixing belt 50 along with the heat generation due to the heat generating layer 50*a* of the fixing belt 50 using the IH coil unit 52 and the heat generation by the magnetic shunt alloy layer 70. The gap G3 between the auxiliary heat generating plate 71 and the magnetic shunt alloy layer 70 contributes to prevent the heat generated by the auxiliary heat generating plate 71 from being directly conducted to the magnetic shunt alloy layer 70. That is, the gap G3 slows the heat conduction from the auxiliary heat generating plate 71 to the magnetic shunt alloy layer 70, and slows the magnetic shunt alloy layer 70 reaching the Curie temperature Tc.

As illustrated in FIG. 8, the magnetic flux generated by the IH coil unit 52 forms a first magnetic circuit 81 induced in the heat generating layer 50*a* of the fixing belt 50. The magnetic flux generated by the IH coil unit 52 forms a third magnetic circuit 83 induced in the magnetic shunt alloy layer 70 and a fourth magnetic circuit 84 induced in the auxiliary heat generating plate 71.

The auxiliary heat generating plate 71 assists the heating of the fixing belt 50 by the heat generating layer 50*a* of the fixing belt 50 and the magnetic shunt alloy layer 70 during the warming up of the fixing belt 50, thereby accelerating the warming up. The auxiliary heat generating plate 71 assists the heating by the heat generating layer 50*a* of the fixing belt 50 during the printing along with the magnetic shunt alloy layer 70, and contributes to maintain the fixing temperature. The auxiliary heat generating plate 71 generates heat due to magnetic flux generated by the IH coil unit 52 after the temperature of the magnetic shunt alloy layer 70 reaches the Curie temperature Tc, and assists the heating by the fixing belt 50.

Figure 10:
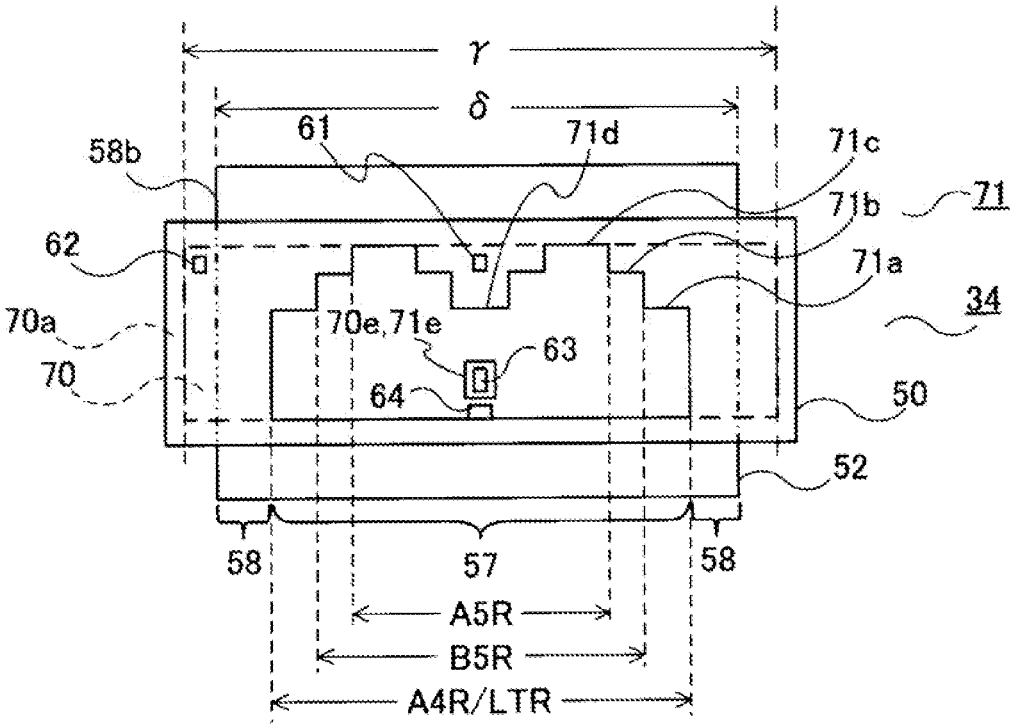
FIG. 10 illustrates the auxiliary heat generating plate, the magnetic shunt alloy layer, the fixing belt, and the IH coil unit viewed from the auxiliary heat generating plate side according to the second embodiment.

As illustrated in FIG. 10, the auxiliary heat generating plate 71 includes a plurality of widths in a step form. For example, the first step 71*a* of the auxiliary heat generating plate 71 is formed with a width that covers a JIS standard A4R size and letter size area. The second step 71*b* of the auxiliary heat generating plate 71 is formed with a width that covers a JIS standard B5R size area. The third step 71*c* of the auxiliary heat generating plate 71 is formed with a width that covers a JIS standard A5R size area.

The auxiliary heat generating plate 71 is formed in the step form, and whereby adjusts the heat generation amount of the auxiliary heat generating plate 71 in the width direction of the fixing belt 50. When small-size sheets P are continuously fixed, the heat generation amount of the auxiliary heat generating plate 71 in the non-paper feeding region is small, and the fixing belt 50 is suppressed from generating heat excessively in the non-paper feeding region. The auxiliary heat generating plate 71 is formed in the step form, thereby achieving uniformity of the temperature of the fixing belt 50 in the width direction. As long as excessive heat generation in the non-paper feeding region is able to be suppressed, the shape of the auxiliary heat generating plate 71 is not limited. The auxiliary heat generating plate 71 includes a notch section 71*d* in the center region, and prevents heat generation by the auxiliary heat generating plate 71 from influencing the detection results of the center thermistor 61, thereby increasing the precision of temperature detection by the center thermistor 61.

The width of the first step 71*a* of the auxiliary heat generating plate 71 is approximately the same width as the region of the first core 57 of the IH coil unit 52. The width γ of the magnetic shunt alloy layer 70 is greater than the width δ of the IH coil unit 52. The edge thermistor 62 is disposed at a position facing a region between the end portion 58*b* of the second core 58 and the end portion 70*a* of the magnetic shunt alloy layer 70 in the width direction of the fixing belt 50. By disposing the edge thermistor 62 outside the end portion 58*b* of the second core 58, the temperature of the fixing belt 50 is detected without an influence of temperature rise due to the second core 58. Thus, the edge thermistor 62 detects the temperature of the end portion of the fixing belt 50 without being influenced by the second core 58. The edge thermistor 62 can detect the temperature of the edge region of the fixing belt 50 with high precision.

The thermostat 63 is disposed at the center notch section 71*e* formed approximately in the center of the auxiliary heat generating plate 71. The magnetic shunt alloy layer 70 includes a notch section 70*e* in a region facing the center notch section 71*e*. The third thermistor 64 is disposed at a position separated from the heating region of the IH coil unit 52 of the auxiliary heat generating plate 71, which is on substantially the same location as the disposition position of the thermostat 63 in the rotation direction of the fixing belt 50.

During Warming Up

During the warming up, the magnetic flux of the IH coil unit 52 is induced in the first magnetic circuit 81 that passes through the heat generating layer 50*a* of the fixing belt 50, and causes heat in the heat generating layer 50*a*. The magnetic flux of the IH coil unit 52 passing through the fixing belt 50 is induced in the third magnetic circuit 83 that passes through the magnetic shunt alloy layer 70, and causes heat in the magnetic shunt alloy layer 70. The magnetic flux of the IH coil unit 52 passing through the magnetic shunt alloy layer 70 is induced in the fourth magnetic circuit 84 that passes through the auxiliary heat generating plate 71, and causes heat in the auxiliary heat generating plate 71.

The heat generated by the magnetic shunt alloy layer 70 is conducted to the fixing belt 50 via the gap G2. The heat generated by the auxiliary heat generating plate 71 is conducted to the fixing belt 50 via the gaps G3 and G2. The conducted heat from the magnetic shunt alloy layer 70 and the auxiliary heat generating plate 71 to the fixing belt 50 contribute to a rapid increase in the temperature of the fixing belt 50. The IH control circuit 67 feedback controls the driving circuit inverter based on the detection results of the center thermistor 61 or the edge thermistor 62. When the fixing belt 50 has a thin heat generating layer 50*a* and a low heat capacity, the warming up finishes in a short period.

During Fixing Operation

During the fixing of the toner image to the sheet P by the fixing apparatus 34 according to a print request, the fixing temperature of the fixing belt 50 is maintained by the feedback control of the IH coil unit 52. When plural sheets are continuously fed at high speeds, insufficiency in the heat generation at the fixing belt 50 is supplemented by heat conduction from the magnetic shunt alloy layer 70 and the auxiliary heat generating plate 71 to the fixing belt 50. Even during the continuous paper feeding at high speeds, the temperature of the fixing belt 50 is maintained at the fixing temperature.

When Magnetic Shunt Alloy Layer 70 Reaches Curie Temperature

For example, when plural sheets are continuously fed at high speed, and thus the fixing belt 50 should be maintained at the fixing temperature, the magnetic shunt alloy layer 70 gradually rises in temperature. The magnetic shunt alloy layer 70 ceases heat generation when reaching the Curie temperature Tc passing through the temperature of the magnetic shunt alloy layer 70, and can suppresses the temperature of the fixing belt 50 from becoming too high due to heat conduction from the magnetic shunt alloy layer 70.

However, even when the magnetic shunt alloy layer 70 reaches the Curie temperature Tc, the auxiliary heat generating plate 71 generates heat due to the magnetic flux from the IH coil unit 52 passing through the fixing belt 50 and the magnetic shunt alloy layer 70. The heat generated by the auxiliary heat generating plate 71 is conducted to the fixing belt 50 via the gaps G3 and G2. When the magnetic shunt alloy layer 70 reaches the Curie temperature Tc, heating of the fixing belt 50 is supplemented by heat generation by the auxiliary heat generating plate 71.

Even when the magnetic shunt alloy layer 70 reaches the Curie temperature Tc and does not generate heat further, the fixing belt 50 can be maintained at the fixing temperature through heat generation by the auxiliary heat generating plate 71. The fixing belt 50 is held at the fixing temperature, and a load applied to the IGBT element 68*a* or the like of the inverter driving circuit 68 is prevented from increasing.

During the paper feeding, when the temperature of the fixing belt 50 decreases, and the temperature of the magnetic shunt alloy layer 70 decreases to less than the Curie temperature Tc, the magnetic shunt alloy layer 70 generates heat by recovering the characteristics of a ferromagnetic body.

When Temperature of Fixing Belt 50 Rises Excessively

The CPU 100 sets the operational mode of the MFP 10 to the standby mode when the detected temperature by the third thermistor 64 is 220° C. or more exceeding the various control temperature ranges of the fixing belt 50. When the temperature of the fixing belt 50 is lowered during the standby mode and the detected temperature of the third thermistor 64 is 180° C. or lower, the CPU 100 switches the operational mode of the MFP 10 to the print mode. The thermostat 63 operates immediately when the temperature of the fixing belt 50 suddenly rises locally, avoiding the risk of the frequent shutdown of the MFP 10. Regardless of whether the temperature of the fixing belt 50 does not reach the threshold value of the thermostat 63, the risk of the malfunction of the thermostat 63 and the frequent shutdown of the MFP 10 can be avoided.

When the fixing belt 50 abnormally generates heat even after the operational mode of the MFP 10 is switched to the standby mode, the thermostat 63 operates and the power supply to the IH coil unit 52 from the IH control circuit 67 is blocked. The fixing apparatus 34 stops generating heat, protecting the fixing apparatus 34 and the MFP 10. By switching the operational state of the MFP 10 to the standby mode before the thermostat 63 operates, the risk of the MFP 10 being shut down can be avoided.

According to the second embodiment, heating of the fixing belt 50 with the thin heat generating layer 50*a* is assisted by the magnetic shunt alloy layer 70 and the auxiliary heat generating plate 71, and the warming up period is further accelerated, thereby achieving reducing energy consumption. The fixing temperature during the fixing is maintained by supplementing heating of the fixing belt 50 having a low heat capacity with the heat generated by the magnetic shunt alloy layer 70 and the auxiliary heat generating plate 71. As a result, a satisfactory fixing capability can be obtained.

According to the second embodiment, the temperature of the fixing belt 50 is suppressed from rising excessively by providing the magnetic shunt alloy layer 70, and thereby the MFP 10 is protected from the heat. However, even when the magnetic shunt alloy layer 70 reaches the Curie temperature Tc, heating of the fixing belt 50 is assisted by heat generation by the auxiliary heat generating plate 71. Even when the temperature of the fixing belt 50 decreases due to the magnetic shunt alloy layer 70 reaching the Curie temperature Tc, the load applied to the IGBT element 68*a* of the inverter driving circuit 68 does not increase so as to hold the fixing belt 50 at the fixing temperature. According to the second embodiment, the auxiliary heat generating plate 71 has the step form, the non-paper feeding region of the fixing belt 50 is prevented from excessively generating heat, thereby achieving uniform heating in the width direction of the fixing belt 50.

According to the second embodiment, similarly to the first embodiment, the third thermistor 64 is included, and the risk of the frequent shutdown of the MFP 10 caused by the thin heat generating layer 50*a* of the fixing belt 50 can be avoided. Thus, the MFP 10 can be operated more efficiently without the frequent shutdown. When the fixing belt 50 abnormally generates heat after the operational mode of the MFP 10 is set to the standby mode, the MFP 10 is shut down by the thermostat 63 operating, thereby obtaining safety in the fixing apparatus 34 and the MFP 10.

According to at least one embodiment described above, even with a fixing belt having the low heat capacity and the thin heat generating layer, the operational mode of the MFP is set to the standby mode before the thermostat operates. The operation of the thermostat when the temperature of the fixing belt rises excessively is avoided and the MFP's frequent shutdown is avoided, thereby achieving an improvement in the operation efficiency of the MFP. When the fixing belt abnormally generates heat, the MFP is shut down by the thermostat operating, thereby obtaining safety in the MFP.

The disclosure is not limited to the embodiments described above, and various modifications thereof are possible. The fixing apparatus may include functions not only of fixing a toner image on a recording medium, but also of decoloring an image on a recording medium.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing apparatus comprising:

a fixing belt to fix an unfixed image on a sheet;

an induction current generator configured to generate in the fixing belt an induction current that causes heating thereof;

a first heating unit configured to generate heat through an induction current generated therein by the induction current generator, and having an opening therein;

a shutdown unit disposed near a surface of the fixing belt and in the opening and configured to cause an electrical connection between a common power source and the fixing apparatus to be cut off when a temperature of the shutdown unit reaches a first predetermined temperature;

a temperature detecting unit disposed near the surface of the fixing belt and configured to detect a temperature at a location of the temperature detecting unit; and a control unit configured to turn off the induction current generator and stop a fixing operation to fix the unfixed image, without causing the electrical connection between the common power source and the fixing apparatus to be cut off, when the detected temperature reaches a second predetermined temperature that is smaller than the first predetermined temperature during the fixing operation.

2. The fixing apparatus according to claim 1, wherein the control unit is further configured to turn on the induction current generator and resume the fixing operation, when the detected temperature decreases to a third predetermined temperature that is smaller than the second predetermined temperature, after the induction current generator has been turned off and the fixing operation has been stopped.

3. The fixing apparatus according to claim 1, wherein both the shutdown unit and the temperature detecting unit are disposed near a region of the fixing belt in which the induction current is generated.

4. The fixing apparatus according to claim 3, wherein both the shutdown unit and the temperature detecting unit are disposed near a region of the fixing belt located centrally between ends of the fixing belt in a width direction thereof.

5. The fixing apparatus according to claim 1, the temperature detecting unit is disposed on the first heating unit.

6. The fixing apparatus according to claim 1, further comprising:

a second heating unit that is configured to generate heat through an induction current generated therein by the induction current generator, and disposed between the fixing belt and the first heating unit, wherein the first heating unit is formed of a magnetic material having a Curie temperature that is higher than the second predetermined temperature, and the second heating unit is formed of a magnetic shunt alloy having a Curie temperature that is lower than the second predetermined temperature.

7. An image forming apparatus, comprising:

an image forming section configured to form an unfixed image on a sheet;

a fixing section configured to fix the unfixed image on the sheet, the fixing section including:

a fixing belt to fix the unfixed image on the sheet, an induction current generator configured to generate in the fixing belt an induction current that causes heating thereof, a first heating unit that is configured to generate heat through an induction current generated therein by the induction current generator, and formed of a magnetic material having a Curie temperature that is higher than the second predetermined temperature, a second heating unit that is configured to generate heat through an induction current generated therein by the induction current generator, disposed between the fixing belt and the first heating unit, and formed of a magnetic shunt alloy having a Curie temperature that is lower than the second predetermined temperature, a shutdown unit disposed near a surface of the fixing belt and configured to cause an electrical connection between a common power source and the image forming apparatus to be cut off when a temperature of the shutdown unit reaches a first predetermined temperature, and a temperature detecting unit disposed near the surface of the fixing belt and configured to detect a temperature at a location of the temperature detecting unit;

a sheet conveying section configured to convey the sheet from the image forming section towards the fixing section; and a control unit configured to turn off the induction current generator and stop a printing operation, without causing the electrical connection between the common power source and the image forming apparatus to be cut off, when the detected temperature reaches a second predetermined temperature that is smaller than the first predetermined temperature during the printing operation.

8. The image forming apparatus according to claim 7, wherein the control unit is further configured to turn on the induction current generator and resume the printing operation when the detected temperature decreases to a third predetermined temperature that is smaller than the second predetermined temperature, after the induction current generator has been turned off and the printing operation has been stopped.

9. The image forming apparatus according to claim 7, wherein both the shutdown unit and the temperature detecting unit are disposed near a region of the fixing belt in which the induction current is generated.

10. The image forming apparatus according to claim 7, wherein both the shutdown unit and the temperature detecting unit are disposed near a region of the fixing belt located centrally between ends of the fixing belt in a width direction thereof.

11. The image forming apparatus according to claim 7, wherein the temperature detecting unit is disposed on the first heating unit.

12. The image forming apparatus according to claim 7, wherein the first heating unit has an opening therein, and the shutdown unit is disposed in the opening.

13. A method for operating an image forming apparatus comprising:

heating a fixing belt to fix an unfixed image on a sheet, through an induction current generated therein by an induction current generator;

conveying the sheet towards the fixing belt;

cutting off an electrical connection between a common power source and the image forming apparatus, by a shutdown unit disposed near surface of the fixing belt and in an opening of a heating unit that generates heat through an induction current generated therein by the induction current generator, when a temperature at a first region near a surface of the fixing belt reaches a first predetermined temperature; and turning off the induction current generator and stopping a printing operation, without cutting off the electrical connection between the common power source and the image forming apparatus, when a temperature at a second region near a surface of the fixing belt reaches a second predetermined temperature that is smaller than the first predetermined temperature during the printing operation.

14. The method according to claim 13, further comprising:

turning on the induction current generator and resuming the printing operation, when the temperature at the second region decreases to a third predetermined temperature that is smaller than the second predetermined temperature, after the induction current generator has been turned off and the printing operation has been stopped.

15. The method according to claim 13, wherein both the first and the second regions are near a region of the fixing belt in which the induction current is generated.

16. The method according to claim 15, wherein both the first and the second regions are near a region of the fixing belt located centrally between ends of the fixing belt in a width direction thereof.

* * * * *